United States Patent [19]

Elsässer et al.

[11] Patent Number: 4,688,404

[45] Date of Patent: Aug. 25, 1987

[54] ELECTROMAGNETIC PATTERNING SYSTEM ON A KNITTING MACHINE

[75] Inventors: Heinrich Elsässer, Stuttgart; Wolfgang Kolb, Reutlingen, both of Fed. Rep. of Germany

[73] Assignee: Sulzer Morat GmbH, Filderstadt, Fed. Rep. of Germany

[21] Appl. No.: 823,192.

[22] Filed: Jan. 28, 1986

[30] Foreign Application Priority Data

Jan. 31, 1985 [DE] Fed. Rep. of Germany ..... 3503219

[51] Int. Cl.[4] ..... D04B 9/10

[52] U.S. Cl. ..... 66/219; 66/75.2

[58] Field of Search ..... 66/219, 218, 220, 13, 66/75.2

[56] References Cited

U.S. PATENT DOCUMENTS

| | | | |
|---|---|---|---|
| 3,283,541 | 11/1966 | DeCerjat | 66/75.2 X |
| 3,365,916 | 1/1968 | Ribler et al. | 66/219 |
| 3,518,845 | 7/1970 | DeCerjat | 66/75.2 X |
| 3,535,892 | 10/1970 | Schmidt et al. | 66/219 X |
| 3,605,448 | 9/1971 | Ribler | 66/75.2 X |
| 3,771,327 | 11/1973 | Engelfried | 66/219 |
| 3,812,691 | 5/1974 | Engelfried | 66/219 |
| 3,863,465 | 2/1975 | DeCerjat et al. | 66/219 |
| 3,877,255 | 3/1975 | Allavena | 66/219 X |

*Primary Examiner*—Ronald Feldbaum

[57] ABSTRACT

The invention relates to a magnetic patterning system on a knitting machine, which has knitting tools which are selectable independently of one another. The patterning system comprises ferromagnetic control elements associated with the knitting tools, an electromagnetic control pole which can be excited according to a pattern, and at least one permanent holding pole, the selection of the knitting tools being performed by relative motion between the control elements and the control pole and the holding pole during which motion the control elements adhere or do not adhere to the holding pole depending on the state of excitation of the control pole. To prevent the control elements from having to be already swung or shifted in the area of the control pole, the control pole is designed as a pole for only addressing address sections of the control elements in order to magnetize them, according to the pattern, to remanent north poles or south poles, while the holding pole is designed as a sorting pole in order to attract or repel the address sections according to their remanent magnetization.

18 Claims, 28 Drawing Figures

Fig. 6.
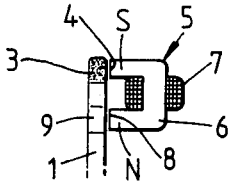
Fig. 7.
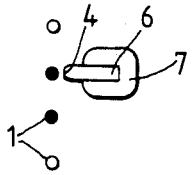
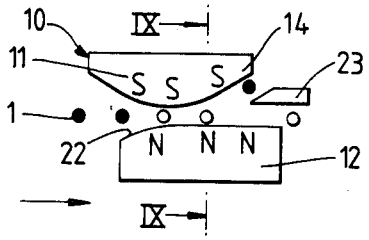
Fig. 8.
Fig. 12.
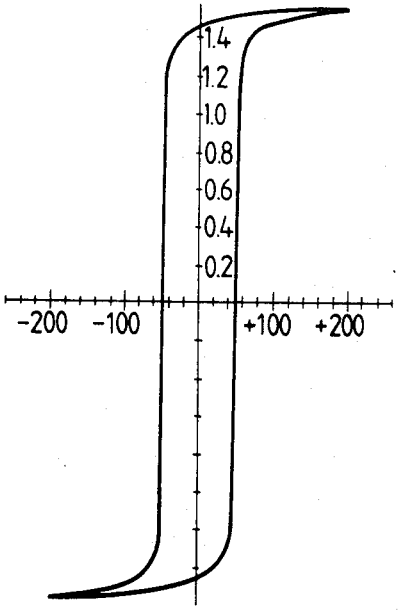
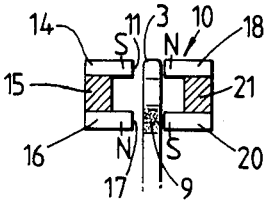
Fig. 9.
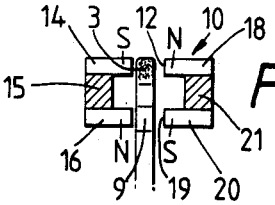
Fig. 10.
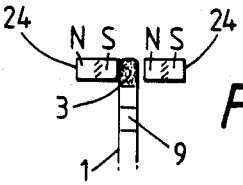
Fig. 11.

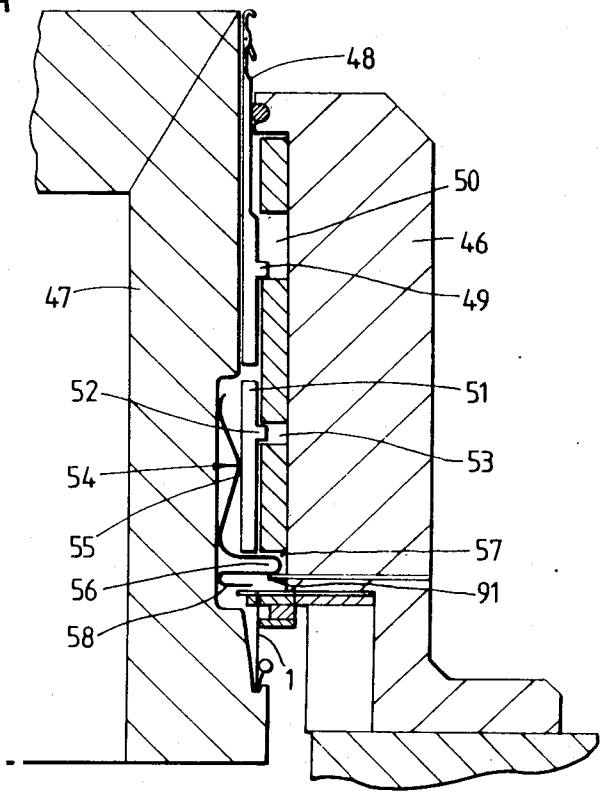
Fig. 18.AA
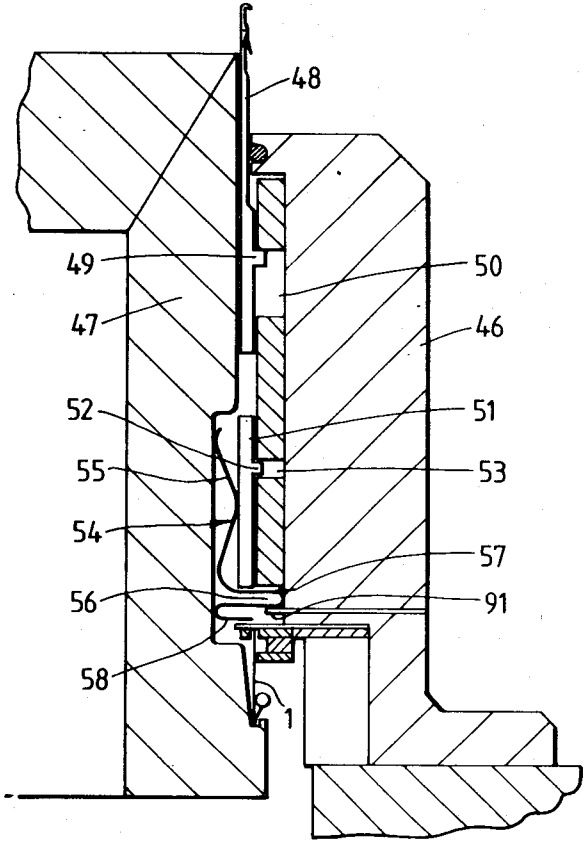

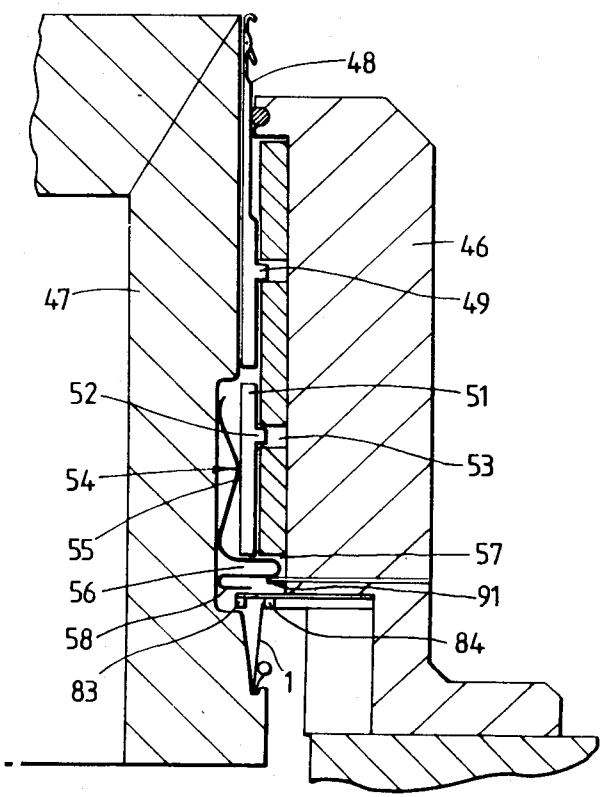
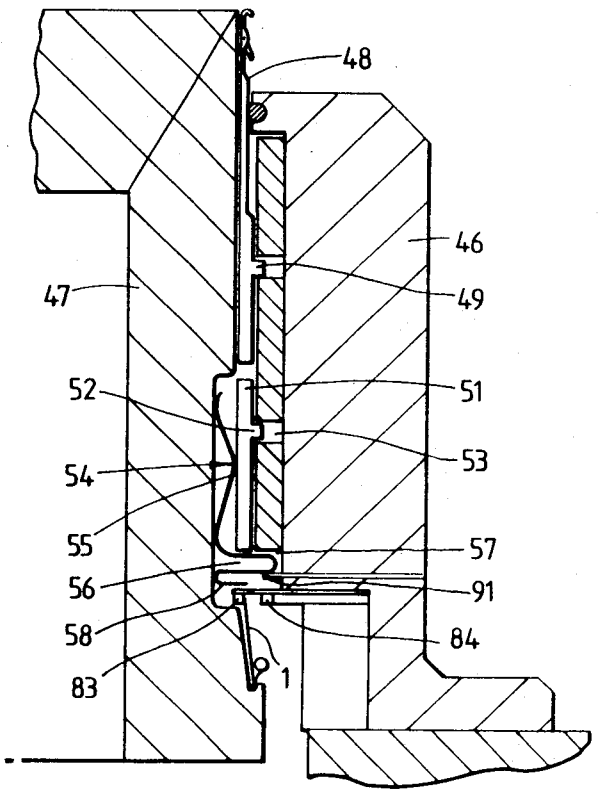
Fig. 19. DD

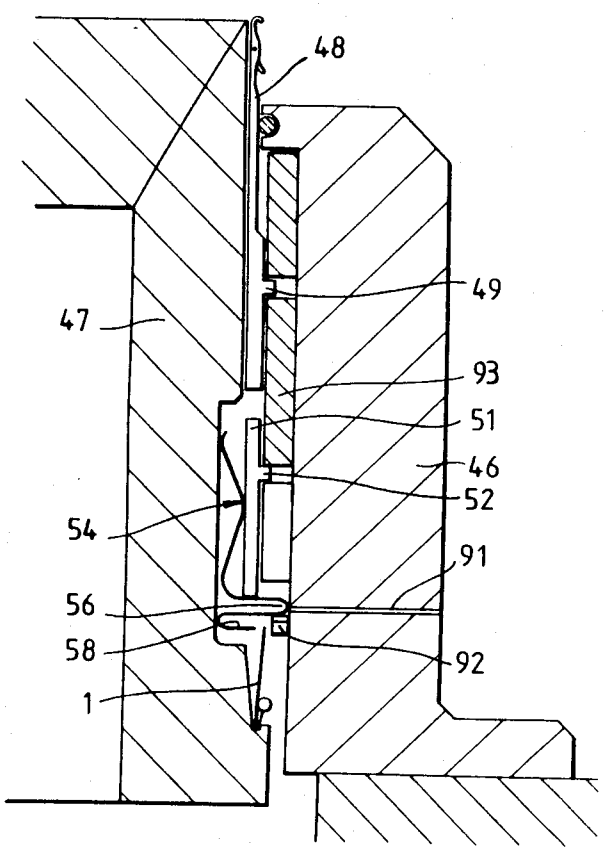
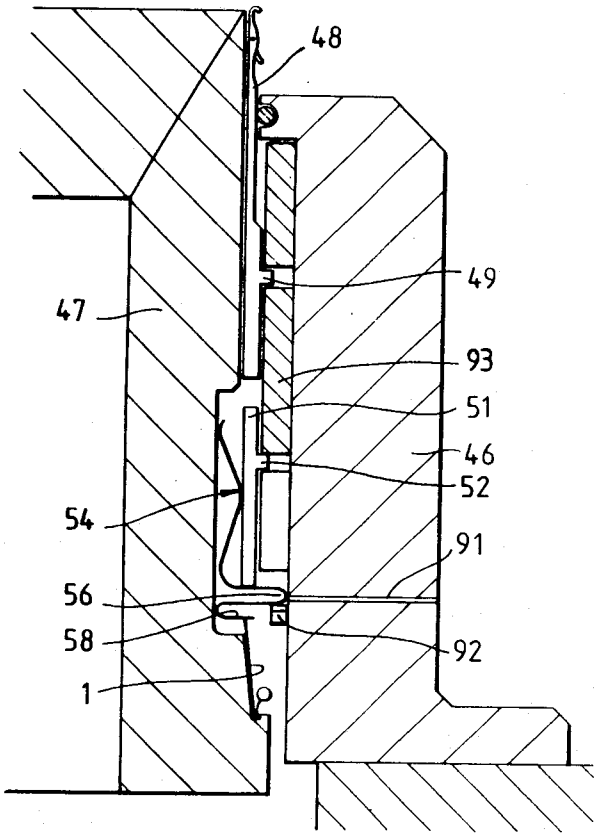
Fig. 20EE

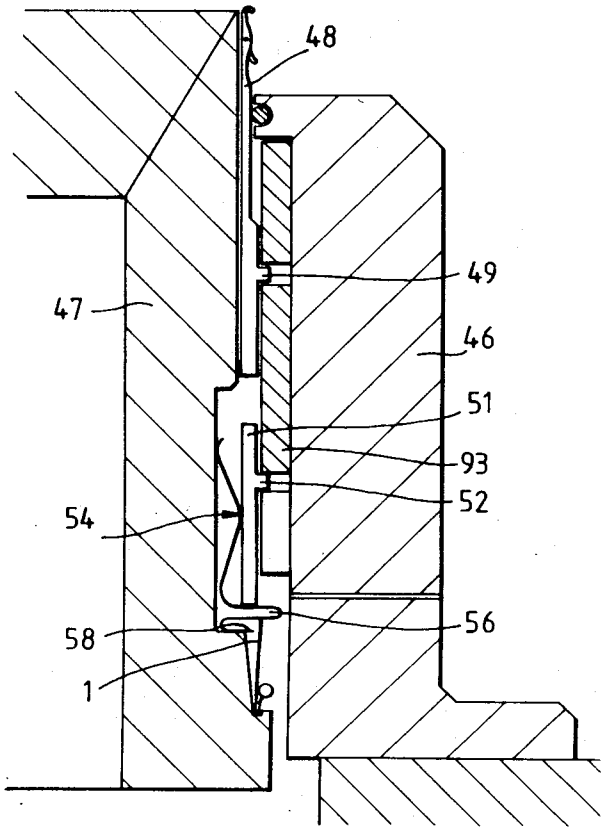
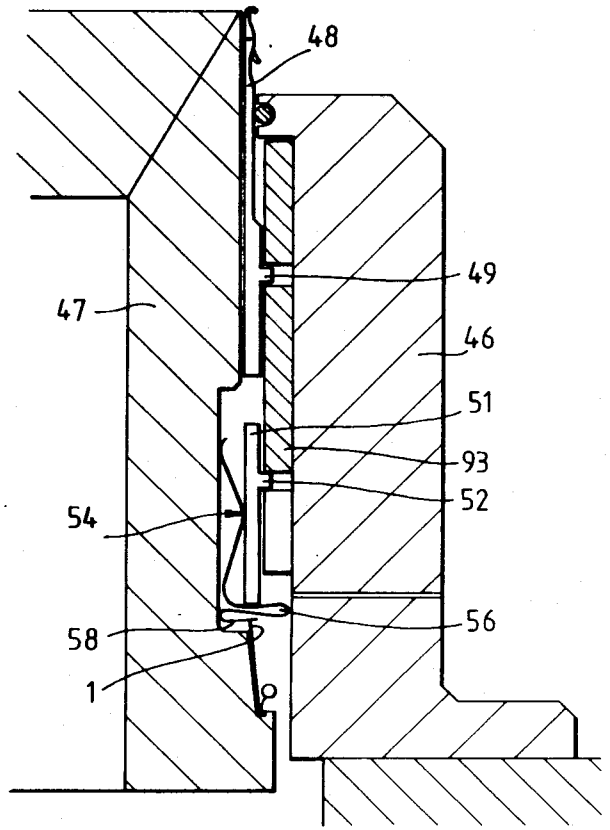
Fig. 21FF

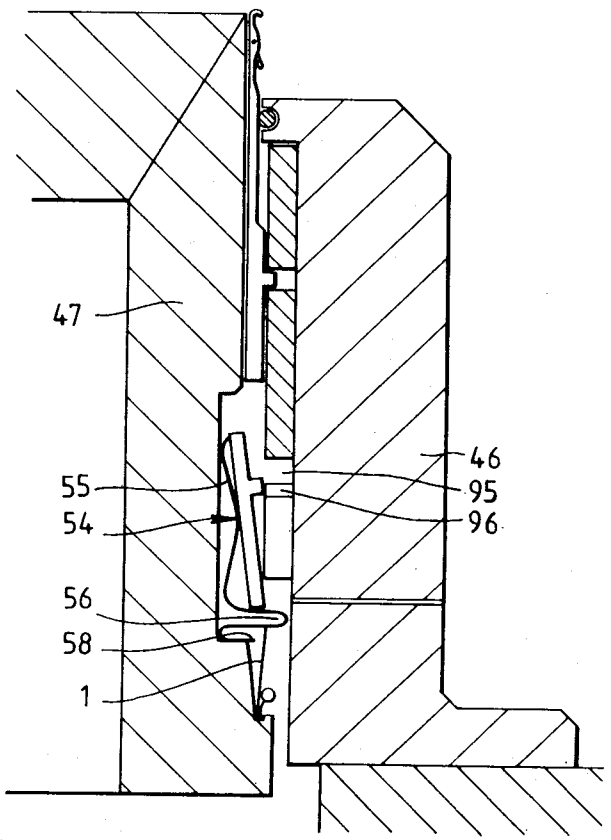
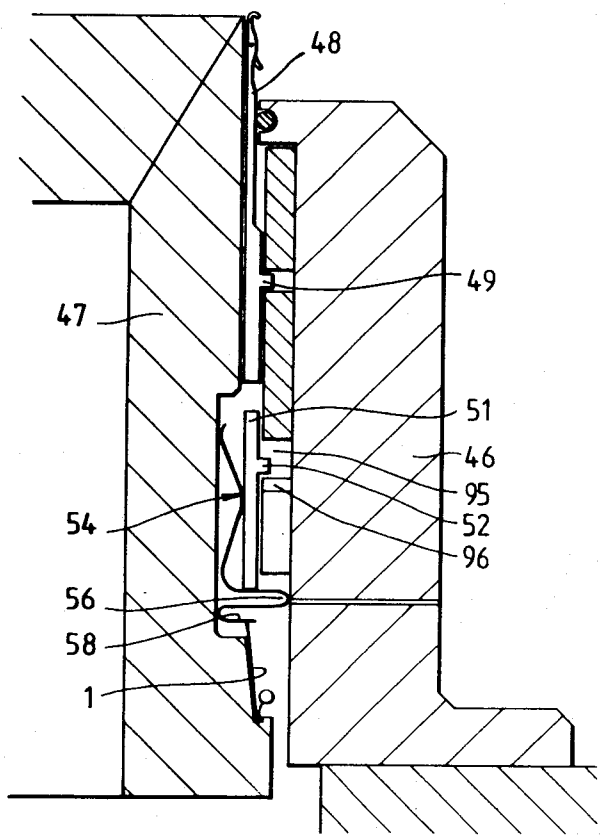
Fig. 22GG

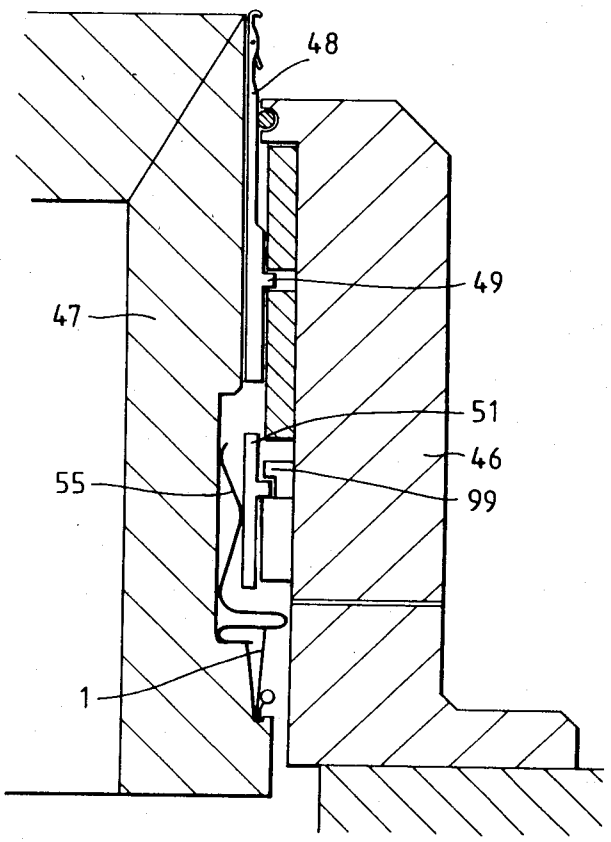
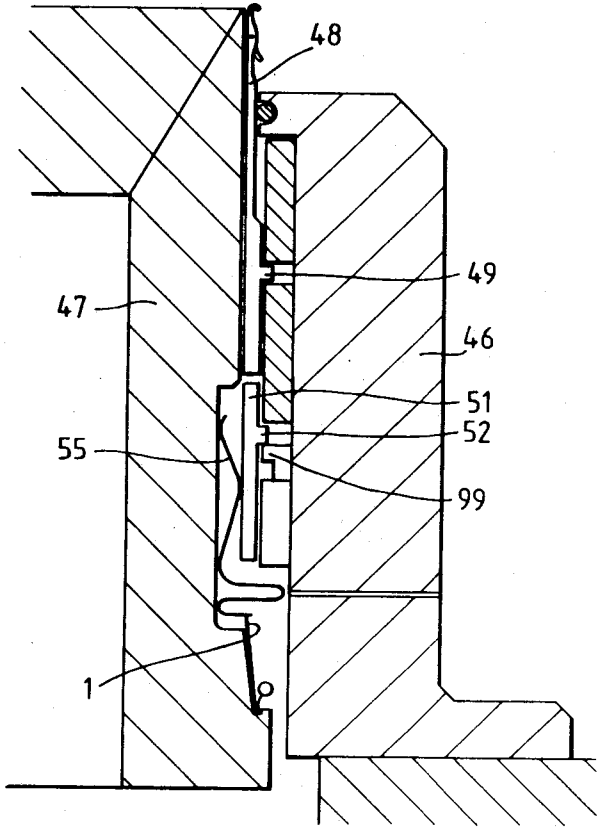
Fig. 23HH

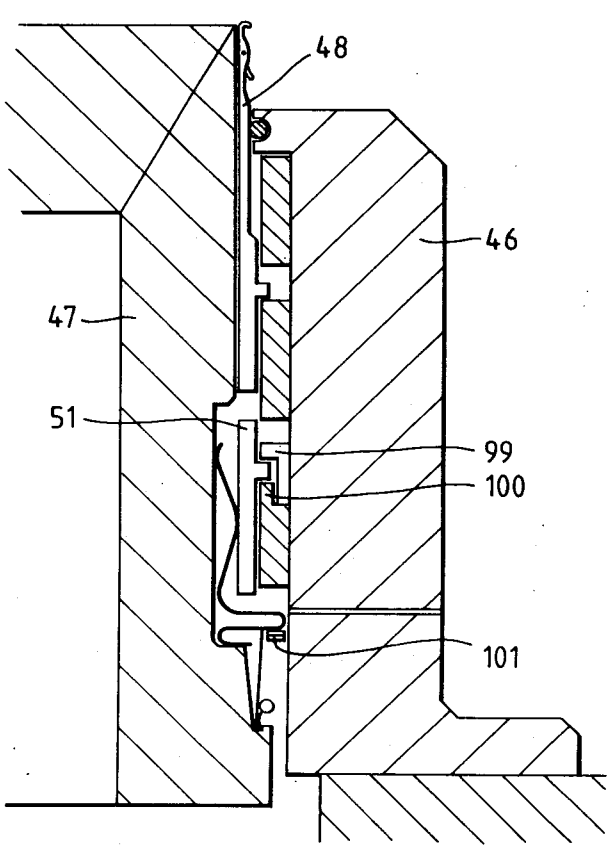
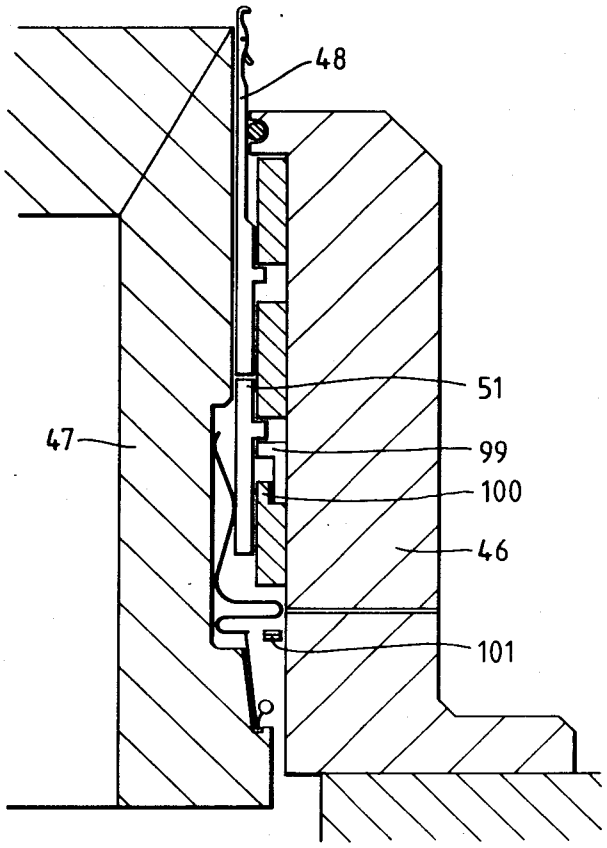
Fig. 24 II

ELECTROMAGNETIC PATTERNING SYSTEM ON A KNITTING MACHINE

BACKGROUND OF THE INVENTION

The invention relates to an electromagnetic patterning system of the class defined in the generic part of claim 1.

Patterning systems of this kind operate on the principle of using electromagnetic means to shift or swing the control elements associated individually with the knitting tools into one of at least two positions in accordance with a pattern. This process, referred to as "sorting the control elements," is necessary in order to bring the knitting tools at a later point in time, and in relation to the position of the control elements, into a knit or missknit position, for example. To avoid having to provide each individual control element with its own electromagnetic patterning system, it is common practice to provide only one patterning system on each knitting system of the knitting machine and to perform the sorting of the control elements either by moving the control elements past the parts of the patterning system which produce the sorting, or, vice versa, by moving the parts which produce the sorting past the control elements. This relative movement is produced, for example, by the rotation of the needle cylinder of a circular knitting machine or the motion of the slide of a flat knitting machine.

There are essentially two possibilities for performing the sorting. The one possibility (German Fed. Pat. 12 69 762) consists in performing the swinging or shifting of the control elements by purely electromagnetic means. This is accomplished, for example, by providing an electromagnetic control pole with a pole face disposed transversely of the direction of the relative movement, which leaves the control elements that run past it either in their current position or pulls them by a defined, even through small amount, to a position different from their current position. According to the other possibility (German Fed. Pat. 15 85 211), however, the shift or swing of the control elements is achieved by mechanical means, for example in that a resiliently biased spring rod is either held by magnetic force or swung by sprung force in the area of the control pole.

These and all comparable electromagnetic patterning system have it in common that the sorting of the control elements i.e., their shifting or swinging to one of the two positions, must take place while the control elements are moving past the control pole. As a rule, holding poles are also provided which follow the control pole in the direction of movement, but their purpose is only to intensify the sorting started in the area of the control poles, i.e., to increase the distances between the control elements in the one or the other position. It follows that the electrical signals fed to the control poles must last at least long enough for the control elements to be shifted or swung by the necessary amount, and that the reliability of the sorting is all the poorer as the relative velocity between the control elements and the control poles is greater and the distance between the individual control elements is smaller. Moreover, control or holding poles with comparatively greater power are needed, and this is undesirable not only for reasons of power consumption, but also because it results in the danger that the control or holding poles will act not only on the control element that is to be selected but also on at least one adjacent control element, thereby impairing reliability of operation.

It is the object of the invention to improve the patterning system of the kind defined above such that it will operate faster, be less liable to trouble, and operate with less powerful control poles or holding poles.

This is to be achieved by making the duration of the excitation of the control poles independent of the swinging or shifting movements of the control elements.

THE INVENTION

The distinctive features of claim 1 are provided for the achievement of this object.

Additional advantageous features of the invention will be found in the subordinate claims.

The invention brings with it a number of advantages. The control elements are provided at the location of the electromagnetic control pole only with an address in the form of a magnetic north or south pole, i.e., they are neither swung nor shifted transversely of the direction of the relative movement. The addresses imparted to the control elements by the control pole are retained, even when the control elements again leave the control pole, and they can then be utilized, at any distance from the control pole, for performing a sort, i.e., shifting or swinging of the control elements, by means of at least one magnetic holding pole which is in the form of a magnetic north or south pole. On the basis of this kind of control, the holding poles do not have to be disposed immediately following the control poles. Furthermore, the control poles need to be excited only for as long as is necessary for the reliable magnetization of the control elements moving past them. This length of time is substantially shorter than the excitement time required in patterning systems of the prior art. Lastly, control poles of comparatively low power can be used, because the magnetic field strengths required for the magnetization of the control elements are lower than the field strengths necessary for the pulling or compensation of the prior-art control elements.

The invention will be further explained hereinbelow through embodiments in conjunction with the appended drawing.

DESCRIPTION OF THE DRAWINGS

FIGS. 6 and 7 show the cross section and the plan view of an addressing magnet for the patterning system according to FIGS. 1 to 5;

FIG. 8 shows a plan view of a sorting magnet for the patterning system according to FIGS. 1 to 5;

FIGS. 9 and 10 show sections along line IX—IX of FIG. 8 for differently magnetized control elements;

FIG. 11 shows a second embodiment of the sorting magnet;

FIG. 12 shows the hysteresis curve of a control element for patterning system according to FIGS. 1 to 5;

FIGS. 18 to 24 are sections taken along lines A—A and D—D to I—I of FIG. 13; they are similar to FIGS. 14 to 17, but correspond in scale to FIG. 13.

DESCRIPTION OF PREFERRED EMBODIMENTS

In each of FIGS. 1 to 5, there is shown in plan a plurality of control elements 1 which, in accordance with FIG. 6, consist of a ferromagnetic rod or spring wire having a circular cross section and a diameter of about 0.5 mm. The points represented in solid black in FIGS. 1 to 5 mean that the control elements 1 have at their visible end a residual or remanent magnetic north pole, while the control elements 1 represented as circles have at their visible end a residual or remanent magnetic south pole. Each of the control elements 1, as it will be explained later on, is associated with a knitting tool, e.g., a needle, a jack, a sinker or a plush hook or sinker or the like, and moves in the direction of the arrow in FIGS. 1 to 5, i.e., from left to right.

Figure 1:
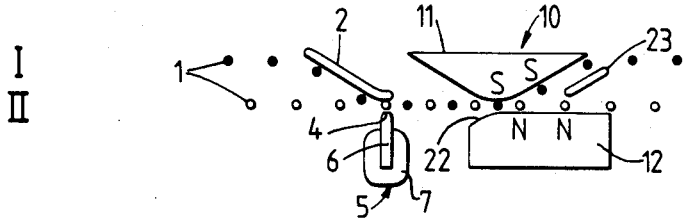
FIGS. 1 to 5 show diagrammatically five embodiments of the system according to the invention.

According to FIG. 1, the control elements coming from the left are divided into two positions, the upper position I, for example, signifying that the corresponding knitting tools in a preceding knitting system have performed a knit, while the lower position II corresponds to a previous non knit or missknit. Before arriving at the knitting system that is next in the direction of the arrow, the control elements of position I first run onto a cam piece or lobe 2 by which they are swung or shifted transversely of their direction of movement to the position II. In this position II, the address sections 3 of all the control elements (FIG. 6) run directly past an addressing pole 4 of an addressing magnet 5. According to FIG. 6, the addressing magnet 5 consists, for example, of a U-shaped core 6 of soft iron around which a coil 7 is wound. The two free ends of the core 6 constitute controllable poles in the form of addressing poles, namely the addressing pole 4 and an additional addressing pole 8 which, when the control elements 1 pass by, can act upon an additional address section 9 thereof. If current is made to flow through the coil 7 in the one direction by the application of an electrical signal, the addressing pole 4 is a magnetic north pole, for example, while at the same time the addressing pole 8 is a magnetic south pole. In the opposite direction of the current, the addressing pole 4 is accordingly south-magnetic, but addressing pole 8 is northmagnetic, as it is assumed in FIG. 6 and indicated by the letters "N" and "S", respectively. The assumed polarization has the result that the control element 1 is magnetized oppositely, i.e., the address section 3 becomes a magnetic north pole (therefore represented in solid black in figure 6), while the address section 9 becomes a magnetic south pole.

On account of the remanence of the ferromagnetic material, the information is kept stored in the address sections 3 and 9 in the form of north or south poles, when the control elements 1 move on to emerge from the range of action of the addressing magnets 5 and approach a sorting magnet 10. The latter contains a permanent sorting pole 11 in the form of a south pole on the one side, and a permanent sorting pole 12 in the form of a north pole on the other side of the path of movement of the control elements 1, both sorting poles 11 and 12 being disposed at the level of the address sections 3. The sorting pole 11 can, according to FIGS. 8 to 10, also consist of the one end of a bar pole shoe 14, whose other end is joined to the one pole of a permanent magnet 15 whose other pole is engaged with one end of another bar pole shoe 16 which forms with its opposite end an additional sorting pole 17 situated at the level of the addressing sections 9. Accordingly, the sorting pole 12 can be the one end of a bar pole shoe 18 which is combined with an additional bar-shaped pole shoe 20 having a sorting pole 19, and with a permanent magnet 21, to form an additional horseshoe magnet.

The ends of the pole shoes 18 and 20 which have the sorting poles 12 and 19 extend, according to FIGS. 1 and 8, substantially parallel to the direction of movement of the control elements 1 entering position II and the immediate vicinity thereof, and they can have a entry ramp 22 at the entry end. The ends of pole shoes 14 and 16 which have the sorting poles 11 and 17, however, are convexly curved transversely of the path of movement of the control elements 1 and are arranged such that they first form an entry funnel with the entry ramp 22, then confront one another at a distance corresponding substantially to the diameter of the control elements 1, and finally, in the manner of an exit funnel, they are at a constantly increasing distance from the sorting poles 12 and 19 across the path of movement of the control elements. The control elements 1 are therefore brought by the entry funnel at first close to the sorting poles 11, 12, 17 and 19, and then, depending on the polarization of their address sections 3 and 9, they are repelled by sorting poles of like polarity and attracted by sorting poles of different polarity, as indicated in FIGS. 9 and 10 for the two possible addresses. Thus, the control elements provided with a south magnetic address section 3 remain in position II after leaving the sorting magnets 10, while the control elements 1 provided with a north magnetic address section 3 are deflected transversely of their direction of movement. As soon as their distance from the control elements remaining in position II is sufficiently great, the deflected control elements run onto a cam 23 of a nonmagnetic material extending into the exit funnel of the sorting magnet 10, and are steered thereby into position I. The control elements 1 separated in this manner then remain in the positions I and II represented in the left portion of FIG. 1 until they enter the next-following knitting system, where they will again be sorted according to the pattern.

As shown especially in FIGS. 9 and 10, for the sorting of the control elements 1 into one or the other positions, which is performed by means of the sorting magnets, that is, to the one or the other side of the cam 23, it matters not whether the sorting magnet 10 acts on only one of the address sections 3 or 9 or on both address sections 3 and 9 of the control elements 1. In principle, it would suffice to have the sorting magnet 10 act on only one of the two address sections 3 or 9 and to close the lines of force of the control element 1 through the air, by having two permanent magnets 24, represented in FIG. 11, acting only on the address sections 3.

The invention is thus based on the idea of addressing the control elements 1 in the area of the addressing magnet 5 in at least one active address section 3, i.e., of making them north magnetic or south magnetic, and of sorting them according to their particular addresses in the area of a sorting magnet 10 disposed behind the addressing magnet 5 in the direction of movement. This principle requires that the magnetic field strengths developed by the sorting magnet 10 be lower than the coercivity of the control elements 1 in the area of the address sections, so that none of the sorting poles can cause any remagnetization of the address sections and hence an erasure or falsification of the stored information, and furthermore that the remanence in the area of the address sections be sufficiently great, since otherwise, in view of the common tolerances, the forces that could be exercised by the sorting poles on the control elements could not be as great as is necessary for their reliable sorting into one or the other position. Lastly, it is to be noted, however, that the coercivity should not be so great that appreciable magnetic field strengths are required for the reverse magnetization of the address sections, because this is undesirable for energy reasons on the one hand, and on the other hand it might have undesirable effects on the control elements that are immediately adjacent to control elements that are to be addressed.

So-called semihard magnetic materials, whose hysteresis curve is represented in FIG. 12, have proven to be suitable for the purposes of the invention, Therein, the field strengths needed for the magnetization are recorded along the abscissae in amperes per centimeter, and the polarization obtained is recorded along the ordinates in teslas. From FIGS. 12 it is apparent that the coercivity, starting out from the saturation level, is approximately 50 amperes per centimeter, while the remanence, also starting out from saturation, amounts to about 1.5 teslas. These values are well suited for addressing and sorting a rod or spring wire consisting of this material, several centimeters long and about 0.5 mm thick in the manner represented in FIG. 1.

In the embodiment according to FIG. 1, current must flow in one or the other direction through the coil 7, for the reverse magnetization of the address sections 3 and 9 in accordance with the pattern. In the embodiment according to FIG. 2, this is avoided by disposing ahead of the addressing pole a permanent north or south magnetic biasing pole 26 which is, for example, a portion of a biasing magnet 27 and can be part of a horseshoe magnet represented in FIGS. 9 and 10. The biasing pole 26 is to reverse-magnetize the address sections 3 or 9 so that, regardless of which polarization they have before reaching the biasing pole 26, they will leave the latter with a certain, always equal premagnetization (bias). The magnetic field strength developed by the biasing pole 26 is therefore greater than the coercivity of the address sections 3 and 9. In the case of the example in FIG. 2, it is assumed that the biasing pole 26 is a south pole, so that all control elements 1 leaving it have been polarized north-magnetic in the associated addressing section 3, as the solid black dots indicate. Therefore no control signal is fed to the coil 7 if the address is to remain north-magnetic, while it is fed with a signal of a certain direction if reverse magnetization to a south pole is desired. In contrast to FIG. 1, therefore, only signals of types "O" or "L" are needed, instead of types "+L" and "−L."

Figure 2:
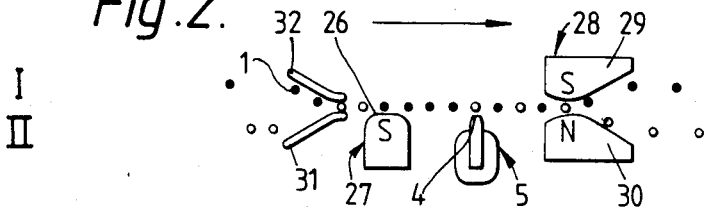

As an additional difference from FIG. 1, in the embodiment according to FIG. 2 a sorting magnet 28 is provided, which has at least two confronting sorting poles 29 and 30, both of which are of convex configuration transversely of the path of movement of the control elements 1. This brings it about that the control elements 1 are deflected, depending on their polarization, both by the sorting pole 29 and by the sorting pole 30, transversely of their direction of movement. In this case the sorting poles 29 and 30 are best made so long that the associated control elements 1 exit into the positions I and II, respectively, so that a cam corresponding to cam 23 (FIG. 1) can be omitted. On the other hand, it is necessary,in contrast to FIG. 1, to provide ahead of the biasing pole 26 two cams 31 and 32 in order to shift or swing the control elements distributed to positions I and II into a basic position situated between these two positions I and II. In this basic position the control elements 1 then move past the biasing pole 26 and the addressing pole 4 to the entry funnel of the sorting magnet 28.

Figure 3:
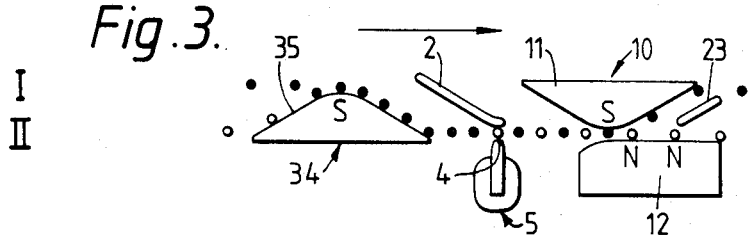

In the embodiment according to FIG. 3, a biasing magnet 34 is provided with a biasing pole 35 which is configured convexly across the path of movement of the control elements 1, and is disposed such that both the control elements 1 that are in position I and those in position II run against it and they are all swung or shifted to position II by the extremity at the exit side of the biasing coil 34. From there on, the addressing and sorting corresponding to those according to FIG. 1.

Figure 4:
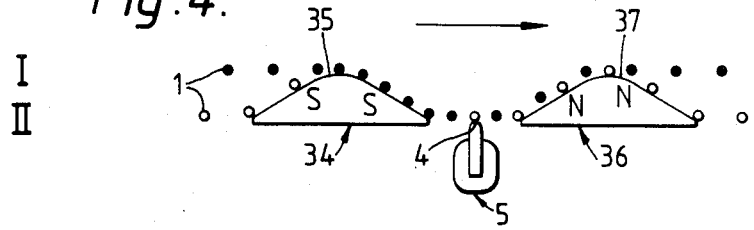

The embodiment according to FIG. 4 differs from that of FIG. 3 only in the construction of the sorting magnet 36. The latter contains a sorting pole 37 that is convexly curved transversely of the direction of movement, and which begins at the level of position II, then rises convexly across the path of movement of the control elements 1 until position I is reached, and then descends convexly across the path of movement of the control elements 1 until it again reaches position II. The control elements 1 which are polarized in the area of the addressing magnet 5 are therefore first shifted or swung into position I by the sorting pole 37 regardless of their address, and then those control elements 1 are withdrawn from position I back to position II which are polarized oppositely in comparison to the sorting pole 37. The control elements provided with the same polarization as the sorting pole 37 are repelled by the sorting pole as soon as they reach it and are thereby released from the sorting pole 37, so that they not only reach position I but also remain therein.

Figure 5:
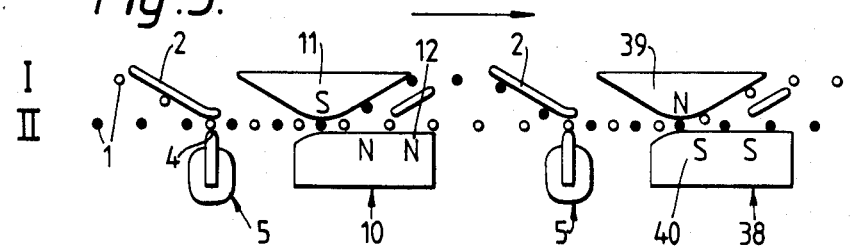

In the embodiment according to FIG. 5, two patterning system are provided, which are associated with two successive knitting systems of a knitting machine. The patterning system is configured in the left part of FIG. 5 the same as in FIG. 1, while the patterning system represented in the right part of FIG. 5 is the same as the one in FIG. 1 except that it has a sorting magnet 38 which has sorting poles 39 and 40 having polarities opposite those of FIG. 1. By this measure it is possible, in a simple manner, to knit, with the patterning system on the right in FIG. 5, a pattern that is the opposite, or a negative pattern, of that of the left patterning system, without the need for re-addressing, since the control elements 1 with a north-magnetic address, for example, brought into position I, are brought by the right-hand patterning system into position II, and vice versa, if no control signals to change the polarization are fed to the right-hand addressing magnet 5. Such patterning systems are therefore especially suitable for the production of 1:1, 2:2, or other such patterns.

The application of the patterning system according to the invention to a circular knitting machine with a rotating needle cylinder will now be described with the aid of FIGS. 13 to 24.

Figure 13:
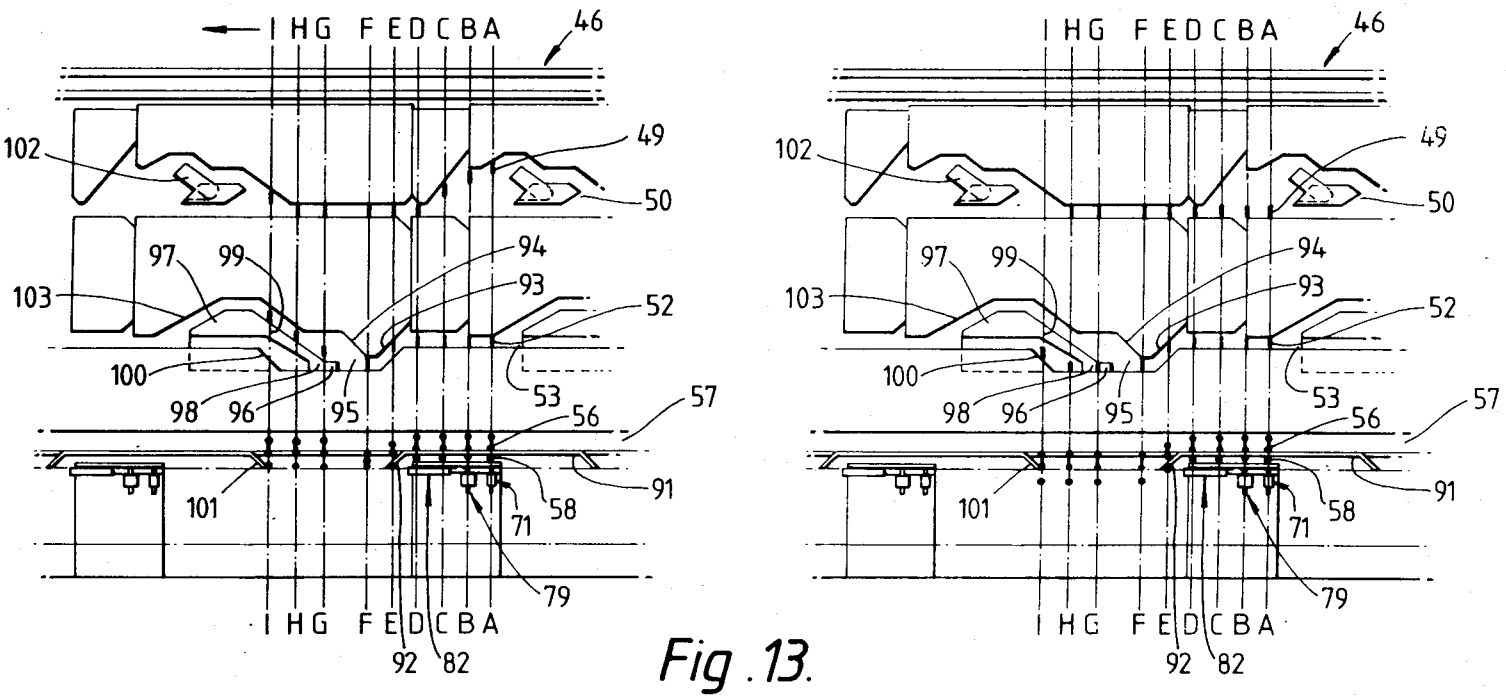
FIG. 13 shows the development of a segment of the cam periphery of a circular knitting machine having a patterning system according to FIG. 2, wherein the cam tracks needed for knitting are shown in the left view and those needed for missknitting are shown in the bottom half.

FIG. 13 shows two identical elevational views of a cylindrical cam 46, as seen in each case from the center of the machine. In the left view, the cam tracks that determine knitting are emphasized, and in the right view the cam tracks that determine missknitting are emphasized. The same applies to the cross sections represented in FIGS. 18 to 24, in which there is also represented a needle cylinder 47 of the circular knitting machine. The direction of rotation of the needle cylinder 47 is indicated by an arrow in FIG. 13.

According to FIGS. 13 and 18, needles 48 with butts 49 are mounted for axial displacement in the channels of the needle cylinder 47, and the butts slide in a needle butt track 50 formed by cam sections. Under the needles 48 are jacks 51 having butts 52 which slide in a jack butt track 53 formed by sections of the cam and are mounted in the channels of the needle cylinder 47 both for axial displacement and for swiveling radially. In the backs of the jacks 51 there are mounted resiliently flexible control springs 54 made, for example, of spring steel. The latter have in their upper portions resilient return-spring sections 55 which thrust against the bottom of the channel and against the back of the jack, and serve for the purpose of biasing the jacks 51 resiliently outward. In a middle or lower section the control springs 54 have a slide foot or butt 56 which consists of a U-shaped section bent radially outward, which reaches beneath the lower jack extremities into a control spring foot track 57. At their bottom end the control springs 54 lastly have a selector foot or butt 58, which can consist of an end of the spring adjoining the slide foot 56 and extending radially outward, which is obtained by another U-shaped bend of the control spring 54. The control springs 54 are resiliently deformable parallel to the axis of the needle cylinder in the portions including the slide feet 56 and the selector feet 58, and furthermore they are mounted so as to be axially displaceable in the cylinder channels. To increase the contact area between the control spring and the control element 1, it is advantageous to flatten the round wire cross section in the area of the control element 1 or to bend it sharply at 180°.

Underneath each control spring 54 there is provided a control element according to the invention, which is disposed substantially parallel to the axis of the needle cylinder 47 and is mounted for swiveling radially. According to FIG. 14, the periphery of the needle cylinder 47 is provided with axis-parallel grooves which are defined on both sides by separators or partition walls 60. In the portion of the needle cylinder 47 associated with the needles 48 and jacks 51, barriers or web plates 61 are inserted into the grooves, which form the channels serving to accommodate the needles and jacks. In the section of the needle cylinder 47 underneath the latter the separator walls 60 are provided with portions 62 and 63 which extend radially outwardly, the radially outermost portions 63 having each a recess into which the bottom end of a control element 1 is inserted for swiveling radially. Into the cylinder grooves formed by the portions 62 and 63 there are loosely inserted plates 65 which rest on the bottom of the grooves and are haled in the cylinder grooves by two mounting springs 66 and 67 one over the other, in the form, for example, of helical springs tightly surrounding the needle cylinder. The position of the mounting springs 66 and 67 is secured by corresponding notches in the portions 63 and in the plates 65. The upper mounting spring 67 is disposed at such an axial level that hooks 68 obtained by bending the bottom ends of the control elements 1 come under them, so that the control elements 1 are thus secured in the position seen in FIG. 14. This arrangement has the advantage that the control elements 1 can be inserted individually into the channels formed by the plates 65, after the removal of the cam jacket 46, and can easily be replaced if necessary. The plates 65 consist preferably of a nonmagnetic material, such as spring bronze or plastic.

Figure 14:
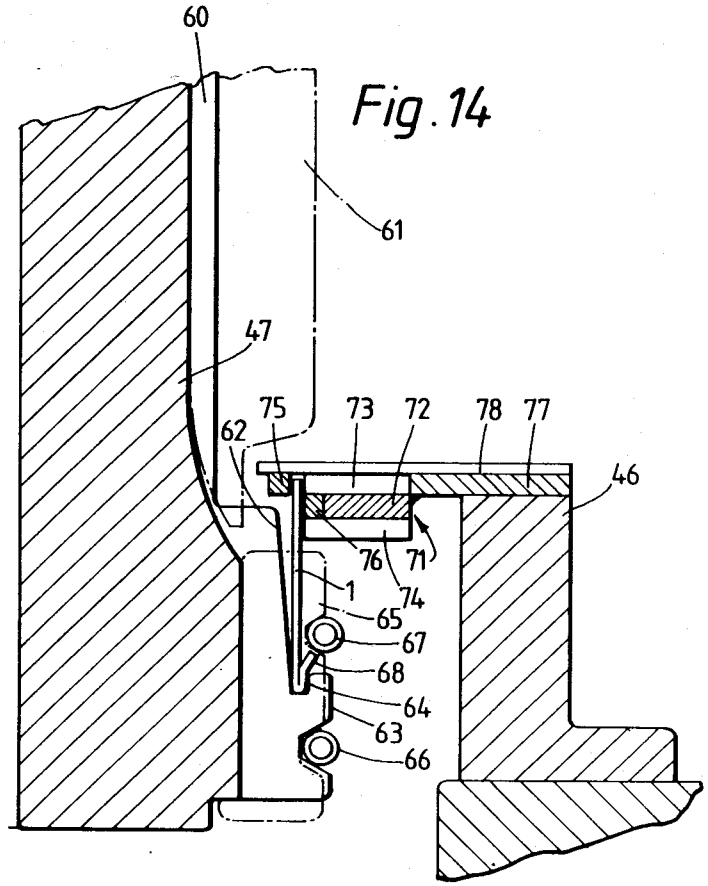
FIGS. 14 and 17 represent enlarged sections along lines A—A, B—B, C—C and D—D through the portion of the cam periphery which has a patterning system according to FIG. 2 and a portion of the needle cylinder of the circular knitting machine.

In FIG. 14 there can furthermore be seen a biasing magnet 71 acting on the upper ends of the control elements 1; it consists of a U-shaped magnet of the kind indicated in FIGS. 9 and 10 and has a permanent magnet 72 and two pole shoes 73 and 74 which are disposed at the level of the address sections 3 and 9, not shown, of the control elements 1, and form with their free ends the biasing poles. On each side of the control elements 1 there is furthermore a wear-resistant guide 75 and 76 consisting preferably of nonmagnetic material, between which the upper ends of the control elements 1 slide, in order to protect the biasing poles against wear. The biasing magnet 71 and the radially outer guide 76 are suspended from a mounting plate 77 fastened to the cam, while the radially inner guide 75 is mounted on a cover 78 removably fastened on the mounting plate 77. The ehtry ends of the guides 75 and 76 can be curved to match the cams 31 and 32 (FIG. 2).

Figure 15:
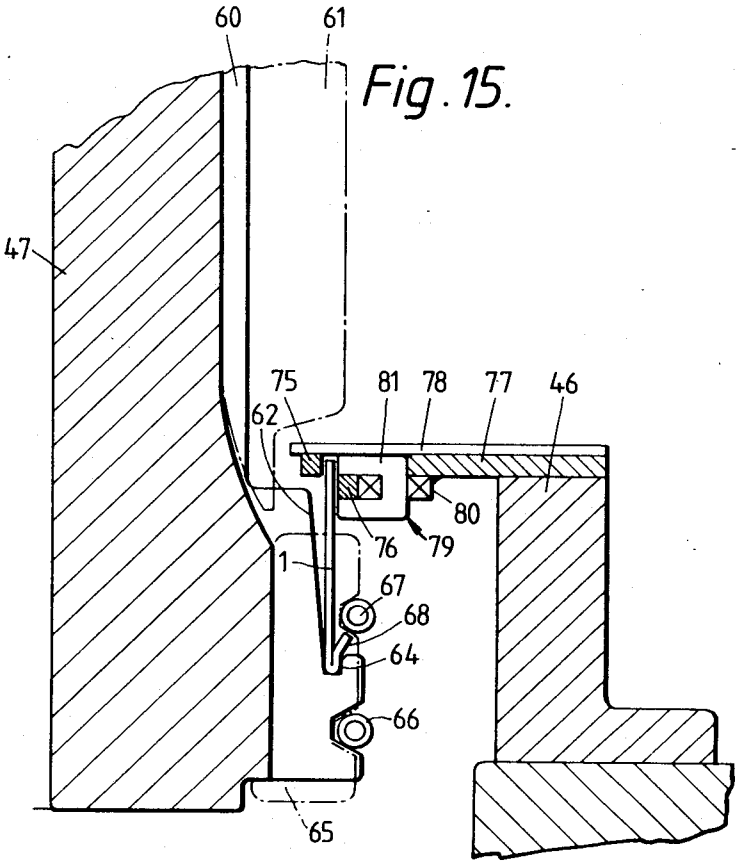

In FIG. 15, the upper end of the control elements 1, after leaving the biasing magnet 71, is guided on between the guides 75 and 76 and moves past an addressing magnet 79 that follows in the direction of rotation of the needle cylinder 47, and which has a U-shaped core 81 whose free ends form the addressing poles associated with the address sections 3 and 9, which are not shown. The addressing magnet 79 is suspended from the mounting plate 77.

Figure 17:
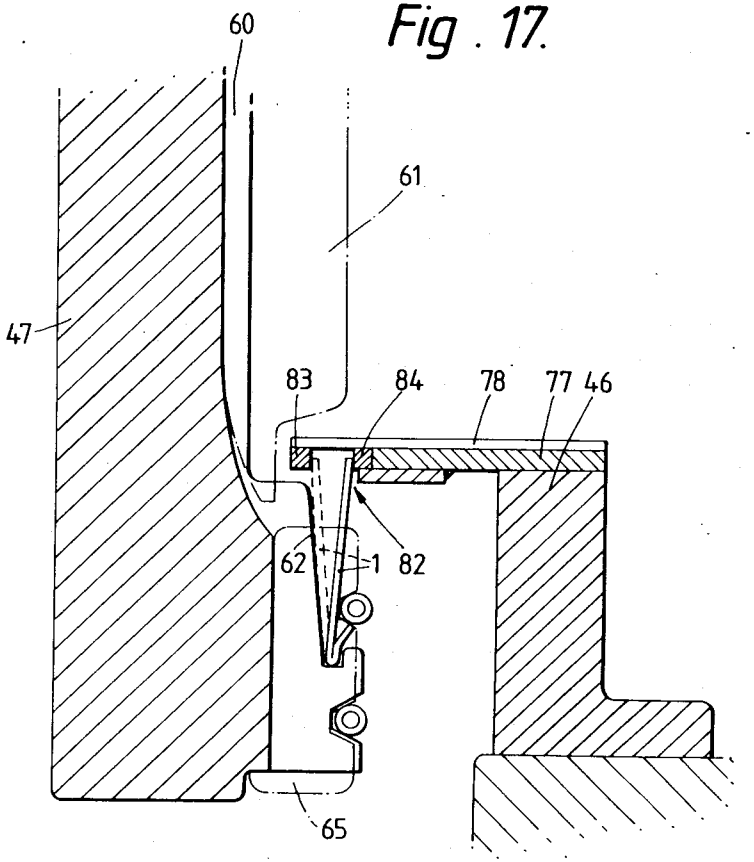
Figure 16:
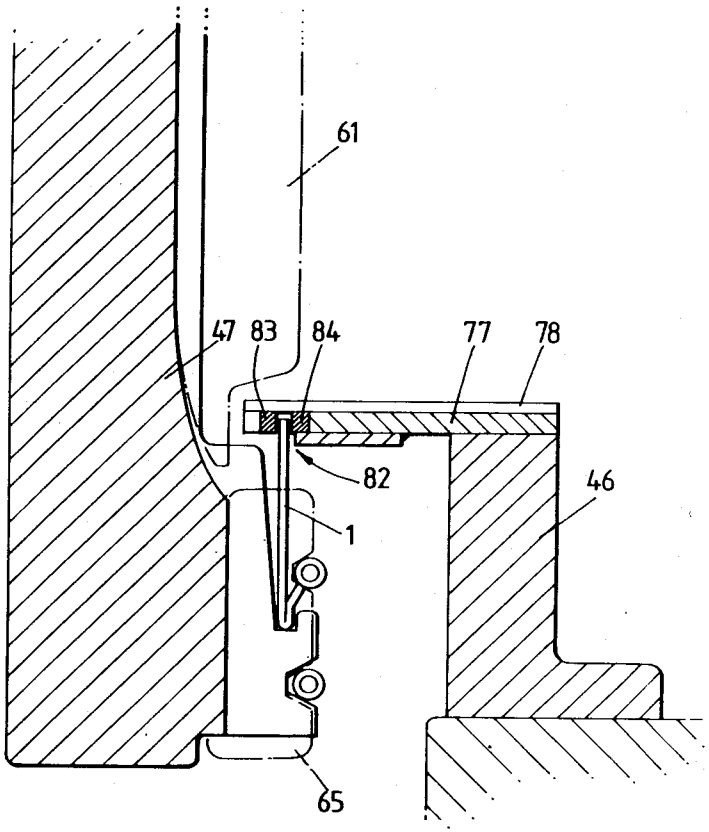

FIGS. 16 and 17 show the sorting process. At a point situated behind the addressing magnet 79 in the direction of rotation of the needle cylinder 47, there is provided a sorting magnet 82 (FIG. 13) acting on the upper address sections 3, which are not shown. The sorting magnet 82 has on the one side of the path of movement of the control elements 1 sorting pole 83, e.g., a north pole, and on the other side of the path of movement an additional sorting pole 84 of the opposite type, e.g., a south pole. The radially inner sorting pole 83 is fastened to the cover 78, and the radially outer sorting pole 84 is fastened to the mounting plate 77. FIG. 16 shows the position of a control element 1 at about the point where the sorting poles 83 and 84 are closest together, while FIG. 17 shows a control element 1 of this kind in the area of the exit funnel of the sorting magnet 82, which can be swung either radially outward (missknit) or radially inward (knit), depending on its addressing. In the knit position the control element 1 lies against the portion 62. Aside from this, the described embodiment has the advantage that the plate 65 can reach in the axial direction right up to the mounting plate 77 or the magnets borne by the latter, so that the control elements are securely guided also in the lateral direction. Otherwise, the sorting described in conjunction with FIG. 2 is substantially the one performed in this embodiment. The magnets or their poles that are represented can be disposed at an angle as a whole, or they can be beveled in order thereby to equalize the different angular attitudes of the control elements.

The manner of operation of the patterning system represented in FIGS. 13 to 24 is as follows: When the needle cylinder 47 revolves in the direction of the arrow, the needles, jacks and control springs represented by their butts run from right to left into the cam segment of FIG. 13 which comprises a complete knitting system. At the point marked by the line A—A, the butts 52 of all jacks are in their normal through-running position, while butts 49 of the needles, depending on whether they have knitted or not in the previous system, may be in a partially extended position and therefore are gradually being pulled down into the through-running position until they reach the line D—D or they are already assuming the through-running position at line A—A. The slide feet 56 of the control springs 54 are located also in a through-running position at line A—A and are held in this position therein by a horizontal guide plate 91 reaching underneath them (FIG. 18). The upper ends of the slide feet 56 are disposed closely beneath the bottoms of the jacks. At the points indicatd by the lines A—A, B—B, C—C and D—D, the biasing, addressing and sorting of the control elements 1 described in conjunction with FIGS. 14 to 17 are performed, which are substantially completed in FIG. 19 corresponding to line D—D. The left view of FIG. 19 shows the radially inwardly swung control elements 1 for the knitting needles, and the lower half the radially outwardly swung control elements 1 for the miss-knitting needles. The knitting needles in the preceding system pulled all the way down into the through-running position in the upper hald of FIG. 19.

In the area of the line E—E (FIG. 20) the slide feet 56 of the control springs 54 encounter a descending section 92 of the guide plate 91, while at the same time the butts 52 of the jacks 51 encounter a descending portion 93 and are lowered by the latter. The needles 48 remain in the through-running position.

The pulling down of the jacks 51 has the result that their bottom ends are pressed against the upper edges of the slide feet 56 of the control springs 54 and push them too axially downward, as indicated in FIGS. 13 and 20. If the control springs 54 are associated with a control element 1 which has been selected to knit and therefore swung radially inward (FIG. 20, left), on account of this downward movement of the jacks 51, the selector foot 58 of the control springs 54 strikes against the upper end of the corresponding control element 1 and is thereby prevented from any further downward movement. If, on the other hand, a control spring 54 is associated with a control element 1 that has been selected to missknit (FIG. 20, right), then the latter is swung radially outward such that the selector foot 58 can be moved downwardly together with the control spring 54 without interference.

FIGS. 13 and 21 show, in the area of the line F—F, the lowest position which the control spring 54 can reach at the end of the descending portion 93. If it is associated with a needle 48 that has been selected to knit (FIG. 21, left), then, in the area which inlcudes the slide foot 56 and the selector foot 58, which is still lying on the corresponding control element 1, the control spring will be resiliently compressed or flexed resiliently in the axial direction, while in the case of selection to missknit (FIG. 21, right it remains virtually in its normal shape and thus its selector foot 58 will lie on the bottom edge of the corresponding channel. The corresponding needles 48 are still in the through position.

The descending portion 93 is contiguous with an ascending portion 94 of the cam. Thus a gap 95 (FIGS. 13 and 22) is formed above the butts 52 of the jacks 51, and as a result those jacks 51 which, as shown in the left view of FIG. 21, are in contact with a resiliently compressed or flexed control spring 54, which is still supported on the corresponding control element 1, will be raised by the resilience of the control spring 54 until the control spring 54 is relaxes, in accordance with the left view of FIG. 13. The control springs 54 which are not supported on a control element 1, however, will remain in the position shown in the right view of FIG. 13 while they are within the gap 95.

Into the bottom portion of the gap 95 extends a section 96 of a cam portion 97 which, as seen from the cam 46, rises radially toward the center of the cam cylinder and is so disposed that it can act only on the butts 52 of the jacks 51 that are selected to missknit. These jacks 51 are therefore gradually swung radially inwardly into the corresponding channel under the bias of the return sections 55 of the control springs 54, until, at the end of the ascending section 96, which is indicated by the line G—G, they are swung completely out of the jack butt track 53 (FIG. 22, right). The butts 52 of the jacks 51 selected to knit are, however, disposed above the radial range of action of section 96, as shown in the left view of FIG. 22, and therefore they are not swung radially by this section 96 but guided on the upper edge thereof.

As it can be seen in FIG. 13, the section 96 of the cam portion 97 is adjoined by a section 98 which, on the one hand, holds the missknitting jacks in the radially swung position (FIG. 13, left view), but on the other hand gradually raises the knitting jacks 51 (FIG. 13, left view). This section 98 is followed, in the direction of rotation of the needle cylinder, by a section 99 of the cam portion 97 which slopes upwardly. The bottom edge of this section 99 releases, as seen in right view of FIGS. 13 and 23, the butts 52 of the jacks 51, which were held in the swung state, in the area of the line H—H, so that these jacks are swung by the effect of the return section 55 of the control springs 54 radially back outward into the jack butt track 53. The ascending upper edge of section 99, however, engages the bottom of the feet 52 of the jacks 51 selected to knit and gradually lifts them further up (FIGS. 13 and 23, left) until their upper edges contact the bottom edges of the needles 48 that are above them, and thus lift them, too (cf. line I—I in the FIGS. 13 and 24, left). The butts 52 of the jacks 51 that have been selected to missknit arrive, at line I—I, in the range of an ejector portion 100 by means of which these jacks return to their normal through-running position. At the same time the slide feet 56 of the control springs 54 encounter an ascending section 101 of the guide plate 91 which raises all the control springs 54 to the normal through-running position. As the movement continues, the jacks 51 selected to knit are lifted by cam portion 97 until the butts 49 of the corresponding needles 48 come into the range of an ejector portion 102 and are ejected by the latter into the knit position, while simultaneously the jacks 51 are pulled down by a pull-down portion 102 to the normal through-running position and, at the end of the cam portion 97, run together with the jacks selected to missknit. The kind of patterning that has been described can then be continued in a subsequent knitting system.

The invention is not limited to the embodiments described, which can be modified in many ways. Instead of the represented control elements 1, control elements of other forms can be used, especially those which contain, in addition to magnetizable sections, other sections made also of nonmagnetizable materials. All that is important is that the area between the two address sections consist of a magnetizable material having a sufficient remanence and coercivity. Furthermore, the control elements can be mounted for sliding instead of swinging. It is furthermore possible to swing the control elements against a light spring force, although this is not necessary if the principle of the invention is applied. The above-described biasing and sorting magnets can consist not only of permanent magnets but also of continuously energized electromagnets. Also, it is possible, in conjunction for example with a flat knitting machine or a circular knitting machine with a revolving cam, to move the above-described biasing, addressing and sorting magnets relative to the control elements. It is also possible to address the control elements only in a middle portion instead of at their one end.

On account of the low magnetic field strengths required, it is furthermore possible to embed in plastic the patterning system block containing the biasing, addressing and sorting magnets. Thus friction surfaces of plastic are produced, on which the control elements can slide without wearing down the magnet pole faces. The air gaps which this creates between the control elements and the magnet poles are acceptable, also in consideration of the low attraction and repulsion forces that need to be applied in range of the sorting magnets. Instead of a selection between knit and missknit, a selection between missknit and tuck or tuck and knit can be provided.

Lastly, a preferred modification of the embodiment according to FIGS. 14 to 17 might consist in lengthening the plates 65 to a point just below the free ends of the control elements 1 and at the same time increase the distance, measured in the direction of the needle cylinder axis, between the pole shoes of the biasing magnet 71 on the one hand and the addressing magnet 79 on the other. This would assure, on the one hand, a guidance of the control elements 1 between the plates 65 also at their upper sections, and, on the other hand, a greater separation of the areas of the control elements 1 that are to be magnetized. So that, in this embodiment too, the bottom pole shoes of the magnets 71 and 79 can reach radially all the way to the control elements, the plates 65 are provided at this point each with a recess accommodating the pole faces. A corresponding recess might also be provided to accommodate the guides 76.

With regard to the embodiment of FIG. 4 it is advantageous to dispose all magnets and cams such that they act on the control elements 1 only from one side, particularly from the outside of the path of movement thereof. In this case contrary to FIGS. 14 to 17 all magnets and cams can be mounted on a common mounting plate, and no means are needed with would have to be disposed behind the control elements 1, e.g. by means of the cover 78. Thus, the assembly of the parts is very much simplified. A particularly preferred embodiment is shown in FIGS. 25 to 28 and described hereinbelow. For thius purpose, identical parts are designated with the same reference numbers according to FIGS. 14 to 17.

Contrary to FIGS. 14 to 17 the plates 56 are provided with extensions 102 at the upper ends thereof, which extensions approximately extend up to the upper edge of the mounting plate 77. In the radial direction the extensions 102 are dimensioned such that they project above the inclined radial portions 62 of the separator walls 60 for a small fraction, i.e. for about a fraction corresponding to the radius of the control elements 1. The portions 62 are inclined such that all control elements 1 which are radially swung inwardly, lie against such portions 62.

The front edge of the mounting plate 1 facing the control elements 1 has—as viewed in the direction of movement of the control elements 1 (see arrow in FIG. 25) - at first a portion 103 inclined from the outside to the inside. Portion 103 is followed by a portion 104 which substantially extends parallel to the periphery of the needle cylinder. Portion 104 is followed by a portion 105 being inclined from the inside to the outside. The distance between the portion 104 and the periphery of the needle cylinder is only slightly greater than the diameter of the control elements 1. The portions 103 to 105 may be made from a material being wear-resistant and preferably unmagnetic. Alternatingly, the control elements could be guided by special guide pieces corresponding to guides 75 and 76.

Figure 26:
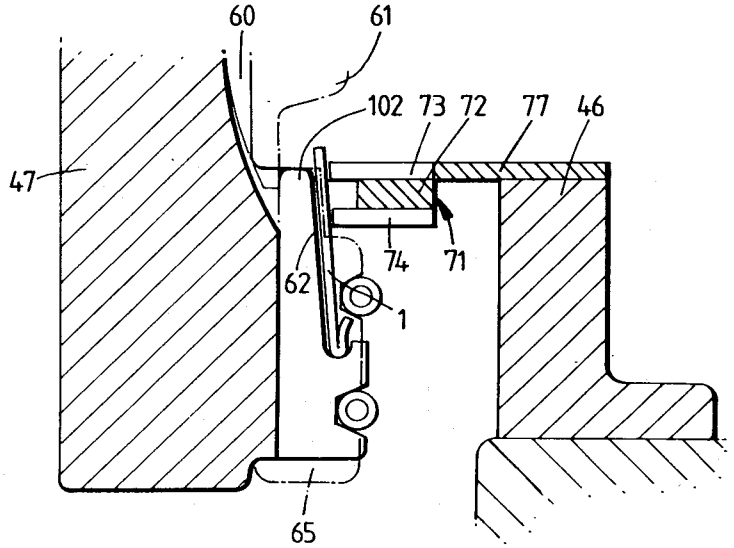
FIGS. 25 to 28 a prefered embodiment of this invention in similar to FIGS. 1, 14, 15 and 17.
Figure 28:
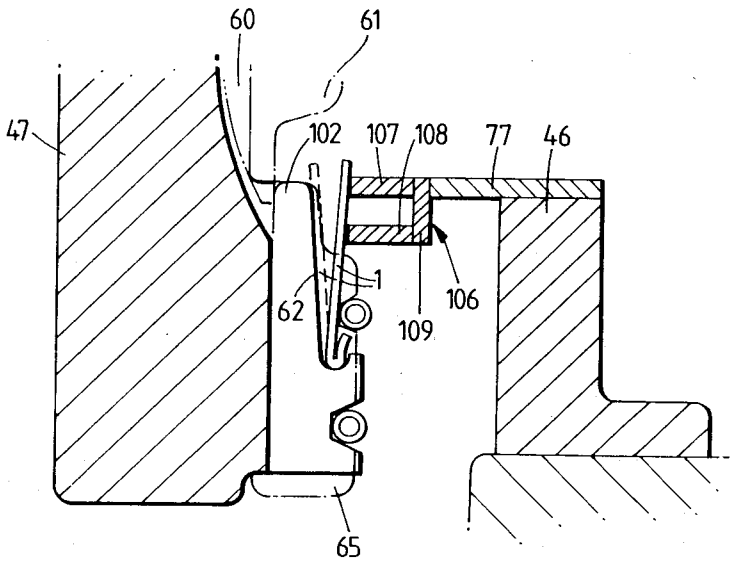
Figure 27:
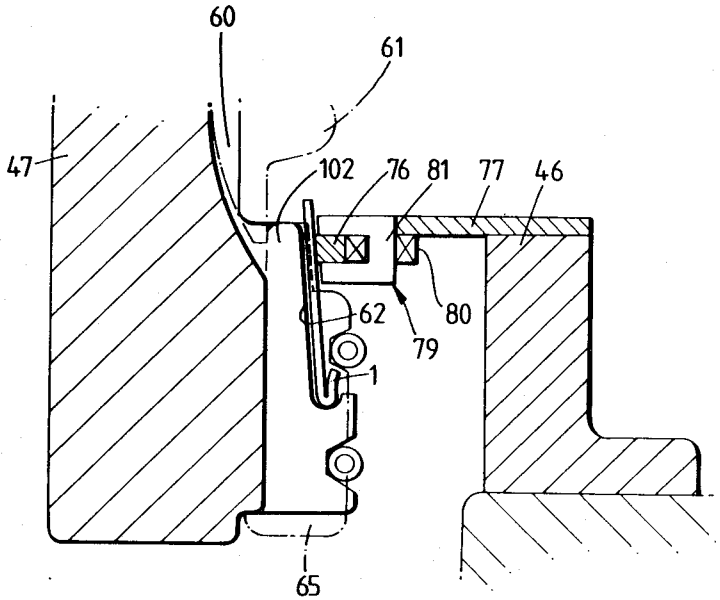

According to FIGS. 26 to 28 at the underside of the mounting plate 77 the premagnetization magnet 71, the addressing magnet 798 and a sorting magnet 106 are mounted. The sorting magnet 106 comprises to permanent magnets 107 and 108, which e.g. are made from oxide magnets and are interconnected by a soft iron plate in a horseshoe-like manner. By way of example, the pole of the permanent magnet 107 facing the control elements 1 is a north pole, while the pole of the permanent magnet 108 facing the control elements 1 is a south pole. The distance between the poles of the permanent magnets 107 and 108 corresponds to the distance between the pole shoes 74 and 75 or the respective pole shoes of the addressing magnet 79, respectively. The radial innermost poles of the permanent magnet 107 and 108 have a portion 110 being parallel to the periphery of the needle cylinder 47 and to the portion 104 of the mounting plate 77, and a following portion 111 which is inclined to the outside and corresponds to the portions 105 of the mounting plate 77. The front edges of the pole shoes of the premagnetization magnet 71 and of the addressing magnet 79 substantially are flush with the portion 104 of the mounting plate 77.

If the control elements 1 are moved towards the mounting plate 77 in the direction of the arrow (FIG. 25), those control elements 1 which have been radially swung outwardly in a preceding system, at first reach the portion 103 of the mounting plate 77 and thus are gradually swung inwardly up to a position where they lie against the portions 62 of he respective separator walls 60 of the needly cylinder, as shown in FIG. 26. The control elements 1 then arrive at the pole shoes 73 and 74 of the premagnetization magnet 71 and are magnetized accordingly. Thereafter the control elements 1 pass the addressing magnet 79 and are addressed in the desired manner. Finally, the control elements 1 reach the portions 110 and 111 of the sorting magnet 106, by which they are left uninfluenced if the polarity is repelling or gradually drawn out of the grooves of the needle cylinder along portions 105 or 111, respectively, if the polarity is attracting.

A particular advantage of the embodiment of FIG. 25 to 28 is the fact that the backs of the control elements 1 permanently lie against the portions 62 of the partition walls 60 as long as the control elements 1 are swung inwardly, such that the portions 62 which consist of a magnetic conducting material, serve as magnetic shunts between the respective pairs of address sections of the control elements 1. Thus, the control elements 1, independently of their state of magnetization, are retained by magnetic forces from the portions 62 of the separator walls 60 as long as they are not drawn radially outwardly by a ortion 111 of one of the sorting magnets 106. Apart from this, all magnets and guides only act on the control elements 1 from the radial outer side such that it is not necessary to provide the mounting plate 77 or the magnets with means which overlap or extend beyond the control elements 1 and have portions being located in the backs of the control elements 1. Further, according to FIGS. 20 to 24 (upper half) only those control elements 1 are mechanically loaded in an axial direction which elements lie against the portion 62 and are attracted therefrom.

The plates 65 may be made from a magnetic conducting or magnetic non-conducting material in this embodiment.

For optimizing the relation between the adhesion forces and draw-off forces, the magnetic shunt may be changed by partially sparing free the contact profile of the portions 62 within the active region of the control elements 1.

Figure 25:
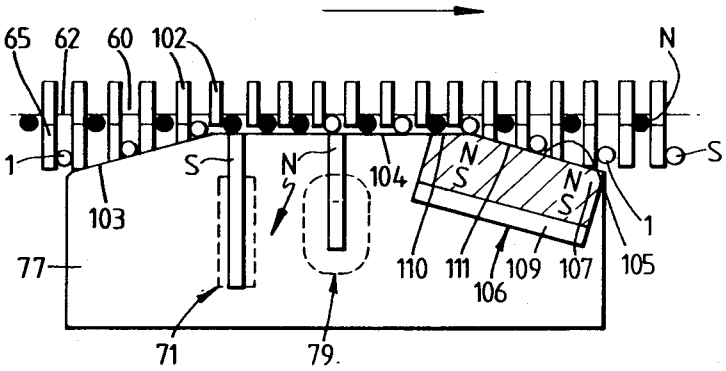

Finally, the section of the needle cylinder 47 shown in FIG. 25 is only shown in a flat development and should be considered slightly curved. Also the mounting plate 77 could be curved, if necessary, within the portion 104. Further, the embodiments described may also be used within a flat knitting machine, in which case the needle bed corresponding to the needle cylinder 47 is stationary, whereas the mounting plate is fastened to a movable part, e.g. a slide, as would also be the case if a circular knitting machine having a rotary cam box ring is used.

We claim:

1. An electromagnetic patterning system on a knitting machine, which has knitting tools which can be selected independently from one another, comprising: ferromagnetic control elements associated individually with said knitting tools, said contol elements having address sections for selectively and permanently storing therein a remanent magnetic north or south pole; an electromagnetic control magnet for being excited according to a pattern and having a control pole for being magnetized as a magnetic north pole or south pole, respectively, in dependence on the excitation of said control magnet; and at least one permanent magnet having a permanent magnetic north pole or south pole, respectively; wherein the selection of the knitting tools is accomplished by relative motion between the control elements and the control magnet and the permanent magnet such that the address sections are first moved past said control pole and then past said permanent magnetic pole, and wherein the selection is further accomplished by using said control magnet only as an address magnet for selectively and remanently magnetizing with said control pole the passing address sections as a north pole or south pole, respectively, without influencing the relative positions thereof, and by using said permanent magnet as a sorting pole for attracting or repelling with said permanent magnetic pole the passing address sections in accordance with the remanent magnetization stored therein.

2. An electromagnetic patterning system on a knitting machine, which has knitting tools which can be selected independently of one another, comprising: ferromagnetic control elements associated individually with said knitting tools, said control elements having address sections for selectively and permanently storing therein a remanent magnetic north or south pole; a first magnet having a first permanent magnetic pole of one of two possible polarities; an electromagnetic control magnet for being excited or non-excited according to a pattern and having a control pole for being magnetized as a magnetic pole of one of said two polarities by excitation of said control magnet or for being non-magnetized by non-excitation of said control magnet; and at least one second permanent magnet having a permanent magnetic pole of one of said two polarities; wherein said selection of the knitting tools is accomplished by relative motion between the control elements and the first permanent magnet, the control magnet and the second permanent magnet such that the address sections are first moved past said first permanent magnetic pole, then past said control poel and then past said second permanent magnetic pole, and wherein the selection is further accomplished by using said first permanent magnet as a pre-magnetization magnet for remanently pre-magnetizing with said first permanent magnetic pole the address sections of the passing control elements as a pole of one of said two-polarities, by using said control magnet only as an address magnet for selectively and remanently magnetizing with said control pole the address sections of passing control elements as a pole of a polarization opposite to the polarization caused by said pre-magnetizing magnet and for leaving the address sections of other passing control elements as a pole of the polarisation caused by said pre-magnetizing magnet, but without influencing the relative positions thereof, and by using said second permanent magnet as a sorting pole for attracting or repelling with said second permanent magnet pole every passing address section in accordance with the remanent magnetization stored therein.

3. A patterning system according to claim 1, wherein the control elements have two oppositely magnetizable address sections, and the address and/or sorting magnet each have two poles of different magnetizability or polarity associated with the address sections.

4. A patterning system according to claim 1 or 2, comprising an additional patterning device having a further sorting pole oppositely magnetized with respect to and disposed following the sorting pole, in the direction of movement.

5. A patterning system according to claim 1 or 2, wherein the sorting pole has a section projecting transversely of the direction of movement and at first deflects all passing control elements toward one position and then pulls control elements having address sections of a polarity opposite that of the sorting pole out of said one position into another position different therefrom.

6. A patterning system according to claim 2, wherein the pre-magnetization pole has a section projecting transversely of the direction of movement and at first deflects all passing control elements toward one position and then pulls the same into another position different therefrom.

7. A patterning system according to claim 2, wherein the control elements have two oppositely magnetizable address sections, and pre-magnetization, addressing and/or sorting magnets are provided which have each two poles of different polarity or magnetizability associated with the address sections.

8. A patterning system according to claim 1 or 2, wherein the control elements consist, in the area of the address sections, of a semi-hard magnetic material.

9. A patterning system according to claim 8, wherein the control elements consist entirely of a semi-hard magnetic material.

10. A patterning system according to claim 1 or 2, wherein the control elements are mounted for swiveling in the knitting machine.

11. A patterning system according to claim 1 or 2, wherein the control elements have each a hook at one end, which reaches reaches underneath a mounting spring stretched over the control elements.

12. A patterning system according to claim 11, wherein the knitting machine has a needle bed having grooves defined by separator walls, and plates held in said grooves by the mounting spring, the control elements being disposed one between each two plates and supported at their ends bearing the hook in recesses in the separator walls.

13. A patterning system according to claim 1 or 2, comprising jacks associated individually with the knitting tools and mounted pivotingly in channels in a needle bed of the knitting machine, and control springs supported in backs of the channels and associated with the jacks and having selector butts cooperating with the control elements.

14. A patterning system according to claim 13, wherein the control springs have each a return section disposed in the backs of the jacks, a slide butt reaching directly under the jacks, and a selector butt disposed under the latter, the sections of the control springs comprising the slide butt and the selector butt being resiliently flexible.

15. A patterning system according to claim 13, wherein the butts of the jacks extend into a jack butt track which has a draw-down portion, the control elements being pivotingly disposed in the channels of the needle bed underneath the selector butts such that, when the jack butts run upon the draw-down portion, the jack butts lay themselves or fail to lay themselves against the selector butts depending on their angular position, and thus the sections of the control springs which include the slide butts and the selector butts, will flex resiliently or will be inflexible so that, within a gap following the draw-down portion, only the jacks associated with the flexed control springs will be lifted by the resilient spring force thereof.

16. A patterning system according to claim 15, wherein the gap is followed by a displacement section which acts only on the butts of the unraised jacks and swings them transversely of its axis.

17. A patterning system according to claim 12, wherein the control elements each have two address sections and in one position lie gainst the separator walls, the separator walls serving to make magnetic shunts between both address sections.

18. A patterning system according to claim 17, wherein the pre-magnetization magnet, the addressing magnet and/or the sorting magnet are fastened to a common mounting plate arranged at a front side of the control elements, without any guiding or selecting elements being arranged in the back of the control elements.

* * * * *